US009275582B2

(12) United States Patent
Yang et al.

(10) Patent No.: US 9,275,582 B2
(45) Date of Patent: Mar. 1, 2016

(54) DUAL SCAN CORRECTION FOR POWER FLUXUATIONS

(71) Applicant: SAMSUNG DISPLAY CO., LTD., Yongin, Gyeonggi-Do (KR)

(72) Inventors: Jin-Wook Yang, Yongin (KR); Bon-Seog Gu, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 157 days.

(21) Appl. No.: 14/047,850

(22) Filed: Oct. 7, 2013

(65) Prior Publication Data

US 2014/0333596 A1 Nov. 13, 2014

(30) Foreign Application Priority Data

May 9, 2013 (KR) ..... 10-2013-0052584

(51) Int. Cl.
*G09G 3/32* (2006.01)
*G09G 3/36* (2006.01)

(52) U.S. Cl.
CPC ..... *G09G 3/3266* (2013.01); *G09G 3/3674* (2013.01); *G09G 2310/0205* (2013.01)

(58) Field of Classification Search
CPC ..... G09G 3/3275; G09G 3/3674; G09G 2310/0283; G09G 2310/0286
USPC ..... 377/64–81
See application file for complete search history.

(56) References Cited

U.S. PATENT DOCUMENTS

2006/0227094 A1* 10/2006 Park et al. ..... 345/100
2007/0147573 A1* 6/2007 Tobita et al. ..... 377/64
2007/0240024 A1* 10/2007 Shin ..... 714/726

FOREIGN PATENT DOCUMENTS

JP 2012-133182 7/2012
KR 10-2011-0070022 6/2011
KR 10-2011-0123525 11/2011
KR 10-2012-0032274 4/2012

* cited by examiner

*Primary Examiner* — Quan-Zhen Wang
*Assistant Examiner* — Chad Dicke
(74) *Attorney, Agent, or Firm* — Lewis Roca Rothgerber Christie LLP

(57) ABSTRACT

A scan driver includes scan-driving blocks, each including a first transistor having a gate coupled to a first node to supply a first power to an output terminal, a second transistor having a gate coupled to a second node to couple a second clock to the output terminal, a third transistor having a gate coupled to a first input to supply the first power to the first node, a fourth transistor having a gate coupled to a second input to supply a second power to the first node, and a fifth transistor having a gate coupled to a first clock to couple the first input to the second node. A first scan-driving block further includes a sixth transistor coupled between the second input and the fourth transistor gate, and a NOT gate configured to invert the first input signal and to supply the inverted signal to the sixth transistor gate.

11 Claims, 10 Drawing Sheets

DUAL SCAN CORRECTION FOR POWER FLUXUATIONS

CROSS-REFERENCE TO RELATED APPLICATION

This application claims priority to and the benefit of Korean Patent Application No. 10-2013-0052584, filed in the Korean Intellectual Property Office on May 9, 2013, the entire content of which is incorporated herein by reference.

BACKGROUND

1. Field

Aspects of embodiments of the present invention relate to a display device, a scan driver, and a driving method thereof.

2. Description of the Related Art

A display device includes a display panel composed of a plurality of pixels arranged in a matrix. The display panel includes a plurality of scan lines arranged in a row direction and a plurality of data lines arranged in a column direction, and the scan lines and the data lines cross each other. The pixels are driven by scan signals and data signals transmitted through the scan lines and data lines, respectively. For displaying an image, the display device sequentially applies a gate-on voltage to the scan lines while applying corresponding data signals to the data lines.

The scan driver has a plurality of scan-driving blocks sequentially arranged to sequentially output the scan signals having the gate-on voltage. By transmitting the scan signal of the current scan-driving block to the next scan-driving block to generate the next scan signal, the scan-driving blocks can sequentially output the scan signals having a gate-on voltage.

While the scan-driving blocks sequentially output the scan signals of the gate-on voltage, power may be abnormally turned off. When the power is turned off, an n-th scan-driving block, having just received a scan signal from the (n−1)-th scan-driving block, may stop operation while one of its capacitors is charged with a voltage. Later, when the power is turned back on, a scan signal of the gate-on voltage may concurrently output from both the first scan-driving block and the n-th scan-driving block (e.g., because of its charged capacitor when the power was turned off). Accordingly, an image of the first frame may not be normally displayed. In addition, when the power is turned back on after the abnormal power-off, a short-circuit may occur in the scan driver, thereby causing damage to the scan driver.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention relate to a display device, a scan driver, and a driving method of the scan driver. Further aspects relate to a display device, a scan driver, and a driving method of the scan driver that can reduce or prevent damage or unintended operation that may occur after an abnormal power-off.

According to an embodiment of the present invention, a scan driver is provided. The scan driving includes a plurality of scan-driving blocks. Each of the scan-driving blocks includes a first transistor having a gate electrode coupled to a first node and configured to supply a first power source voltage to an output terminal, a second transistor having a gate electrode coupled to a second node and configured to couple a second clock signal input terminal to the output terminal, a third transistor having a gate electrode coupled to a first signal input terminal and configured to supply the first power source voltage to the first node, a fourth transistor having a gate electrode coupled to a second signal input terminal and configured to supply a second power source voltage to the first node, and a fifth transistor having a gate electrode coupled to a first clock signal input terminal and configured to couple the first signal input terminal to the second node. A first scan-driving block of the scan-driving blocks further includes a sixth transistor coupled between the second signal input terminal and the gate electrode of the fourth transistor, and a NOT gate configured to invert a signal input through the first signal input terminal and to supply the inverted signal to the gate electrode of the sixth transistor.

Each of the scan-driving blocks may further include a first capacitor including a first terminal coupled to the first power source voltage and a second terminal coupled to the first node.

Each of the scan-driving blocks may further include a second capacitor including a first terminal coupled to the second node and a second terminal coupled to the output terminal.

Each of the scan-driving blocks may further include a third capacitor including a first terminal coupled to the first power source voltage and a second terminal coupled to the output terminal.

The first signal input terminal of the first scan-driving block may be configured to receive a frame start signal. The first signal input terminal of each of the scan-driving blocks after the first scan driving block may be configured to receive a scan signal from a corresponding previous one of the scan-driving blocks.

The second signal input terminal of each of the scan-driving blocks before a final one of the scan-driving blocks may be configured to receive a scan signal of a corresponding next one of the scan-driving blocks.

According to another embodiment of the present invention, a display device is provided. The display device includes a plurality of pixels, a scan driver configured to sequentially apply scan signals of a gate-on voltage to a plurality of scan lines coupled to the pixels, and a data driver configured to apply data signals to a plurality of data lines coupled to the pixels. The scan driver includes a plurality of scan-driving blocks. A first scan-driving block of the scan-driving blocks includes a first transistor having a gate electrode coupled to a first node and configured to supply a first power source voltage to an output terminal, a second transistor having a gate electrode coupled to a second node and configured to couple a second clock signal input terminal to the output terminal, a third transistor having a gate electrode coupled to a first signal input terminal and configured to supply the first power source voltage to the first node, a fourth transistor having a gate electrode coupled to a second signal input terminal and configured to supply a second power source voltage to the first node, a fifth transistor having a gate electrode coupled to a first clock signal input terminal and configured to couple the first signal input terminal to the second node, a sixth transistor coupled between the second signal input terminal and the gate electrode of the fourth transistor, and a NOT gate configured to invert a signal input through the first signal input terminal and to supply the inverted signal to the gate electrode of the sixth transistor.

The first scan-driving block may further include a first capacitor including a first terminal coupled to the first power source voltage and a second terminal coupled to the first node.

The first scan-driving block may further include a second capacitor including a first terminal coupled to the second node and a second terminal coupled to the output terminal.

The first scan-driving block may further include a third capacitor including a first terminal coupled to the first power source voltage and a second terminal coupled to the output terminal.

The first signal input terminal of the first scan-driving block may be configured to receive a frame start signal. The second signal input terminal of the first scan-driving block may be configured to receive a scan signal from a second one of the scan-driving blocks.

According to yet another embodiment of the present invention, a method for driving a scan driver is provided. The scan driver includes a plurality of scan-driving blocks. Each of the scan-driving blocks includes a first node configured to receive a first power source voltage according to a signal applied to a first signal input terminal and to receive a second power source voltage according to a signal applied to a second signal input terminal, a first transistor configured to supply the first power source voltage to an output terminal according to a voltage of the first node, a second node configured to receive the signal applied to the first signal input terminal according to a signal applied to a first clock signal input terminal, and a second transistor configured to couple a second clock signal input terminal to the output terminal according to a voltage of the second node. The method includes: applying a frame start signal of a gate-on voltage to the first signal input terminal of a first scan-driving block among the scan-driving blocks as power of the scan driver is turned on; applying a first clock signal of a gate-on voltage to the first clock signal input terminal of the first scan-driving block and applying a second clock signal of a gate-off voltage to the second clock signal input terminal of the first scan-driving block; and blocking a scan signal of a gate-on voltage of a second scan-driving block of the scan-driving blocks, input to the second signal input terminal of the first scan-driving block when the frame start signal of the gate-on voltage is applied to the first signal input terminal of the first scan-driving block.

The blocking of the scan signal of the gate-on voltage of the second scan-driving block, input to the second signal input terminal of the first scan-driving block when the frame start signal of the gate-on voltage is applied to the first signal input terminal of the first scan-driving block may include: turning on a third transistor having a gate electrode coupled to the first signal input terminal of the first scan-driving block to apply the first power source voltage to the first node of the first scan-driving block by the frame start signal of the gate-on voltage; and turning off a fifth transistor coupled between a gate electrode of a fourth transistor configured to supply the second power source voltage to the first node of the first scan-driving block, and the second signal input terminal of the first scan-driving block.

The turning off the fifth transistor may include inverting the frame start signal of the gate-on voltage and supplying the inverted frame start signal to a gate electrode of the fifth transistor.

The inverting of the frame start signal of the gate-on voltage and the supplying of the inverted frame start signal to the gate electrode of the fifth transistor may include supplying the frame start signal of the gate-on voltage to the gate electrode of the fifth transistor through a NOT gate coupled between the first signal input terminal of the first scan-driving block and the gate electrode of the fifth transistor.

According to still yet another embodiment of the present invention, a method for driving a scan driver is provided. The scan driver includes a plurality of scan-driving blocks. Each of the scan-driving blocks includes a first node configured to receive a first power source voltage according to a signal applied to a first signal input terminal and to receive a second power source voltage according to a signal applied to a second signal input terminal, a first transistor configured to supply the first power source voltage to an output terminal according to a voltage of the first node, a second node configured to receive the signal applied to the first signal input terminal according to a signal applied to a first clock signal input terminal, and a second transistor configured to couple a second clock signal input terminal to the output terminal according to a voltage of the second node. The method includes: turning on power of the scan driver; applying a frame start signal of a gate-off voltage to the first signal input terminal of a first scan-driving block among the scan-driving blocks during a first frame, and driving the scan-driving blocks according to a first clock signal and a second clock signal; and sequentially outputting scan signals of a gate-on voltage by the scan-driving blocks during a second frame according to the frame start signal of the gate-on voltage applied to the first signal input terminal of the first scan-driving block, the first clock signal, and the second clock signal.

According to the above and other embodiments of the present invention, scan driver malfunction or damage due to a short-circuit between a first power source voltage and a second power source voltage, which may occur due to an abnormal power-off, may be reduced or prevented.

DETAILED DESCRIPTION

Figure 1:
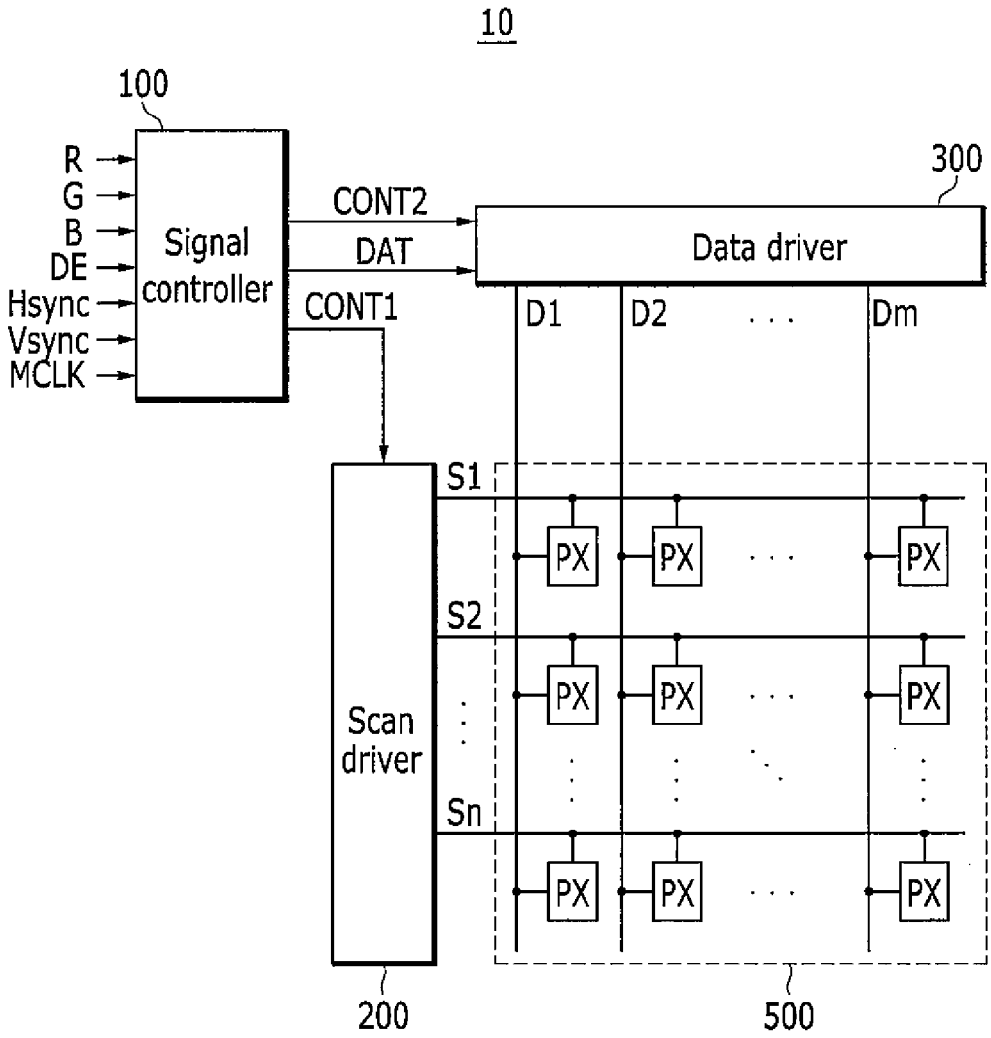
FIG. 1 is a block diagram of a display device according to an embodiment of the present invention.

The present invention will be described more fully hereinafter with reference to the accompanying drawings, in which embodiments of the invention are shown. As those skilled in the art would realize, the described embodiments may be modified in various different ways, all without departing from the spirit or scope of the present invention. Like reference numerals designate like elements throughout the specification. For ease of description, a first embodiment may be representatively described, and in succeeding embodiments, only aspects different from the first embodiment may be described. Accordingly, the drawings and description are to be regarded as illustrative in nature and not restrictive.

Throughout this specification and the claims that follow, when it is described that an element is "coupled" to another element, the element may be directly coupled (e.g., connected) to the other element or indirectly coupled (e.g., electrically connected) to the other element through one or more third elements. In addition, unless explicitly described to the contrary, the word "comprise" and variations such as "comprises" or "comprising," will be understood to imply the inclusion of stated elements but not the exclusion of any other elements. Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

FIG. 1 is a block diagram illustrating a display device 10 according to an embodiment of the present invention.

Referring to FIG. 1, the display device 10 includes a signal controller 100, a scan driver 200, a data driver 300, and a display unit 500. The signal controller 100 receives synchronization signals and video signals R, G, and B input from an external device. The video signals R, G, and B contain luminance information of each of a plurality of pixels PX, where luminance has a set number (for example, a predetermined number) of grays (or gray levels), for example, 1024 ($=2^{10}$), 256 ($=2^{8}$), or 64 ($=2^{6}$) grays. The synchronization signals include a horizontal synchronization signal Hsync, a vertical synchronization signal Vsync, a main clock signal MCLK, and a data enable signal DE.

The signal controller 100 generates a first driving control signal CONT1, a second driving control signal CONT2, and an image data signal DAT according to the video signals R, G, and B, the horizontal synchronization signal Hsync, the vertical synchronization signal Vsync, the data enable signal DE, and the main clock signal MCLK. The signal controller 100 divides the video signals R, G, and B into units of frames according to the vertical synchronization signal Vsync and into units of scan lines according to the horizontal synchronization signal Hsync to generate the image data signal DAT. The signal controller 100 transmits the image data signal DAT and the second driving control signal CONT2 to the data driver 300.

The display unit 500 is a display area including the pixels PX substantially arranged in a matrix format. In the display unit 500, a plurality of substantially parallel scan lines S1 to Sn extend in a row direction and a plurality of substantially parallel data lines D1 to Dm extend in a column direction. The scan lines S1 to Sn and the data lines D1 to Dm are coupled to the pixels PX.

The scan driver 200 is coupled to the scan lines S1-Sn, and generates a corresponding plurality of scan signals S[1] to S[n] according to the first driving control signal CONT1. The scan driver 200 may sequentially apply scan signals S[1]-S[n] of a gate-on voltage to the scan lines S1-Sn, respectively.

The first driving control signal CONT1 includes a frame start signal FLM, a first clock signal SCLK1, and a second clock signal SCLK2. The frame start signal FLM may be a signal that generates the first scan signal S[1] for displaying an image of a single frame. The first clock signal SCLK1 and the second clock signal SCLK2 are synchronization signals for sequential generation and application of the scan signals S[1]-S[n] to the respective scan lines S1-Sn.

The data driver 300 is coupled to the data lines D1-Dm, samples and holds the image data signal DAT according to the second driving control signal CONT2, and applies a plurality of data signals D[1] to D[m] to the data lines D1 to Dm, respectively. The data driver 300 may program data to the pixels PX by applying the data signals D[1] to D[m] having set voltage ranges (for example, predetermined voltage ranges) to the data lines D1 to Dm in accordance with the scan signals S[1] to S[n] of the gate-on voltage being respectively applied to the scan lines S1 to Sn.

Figure 2:
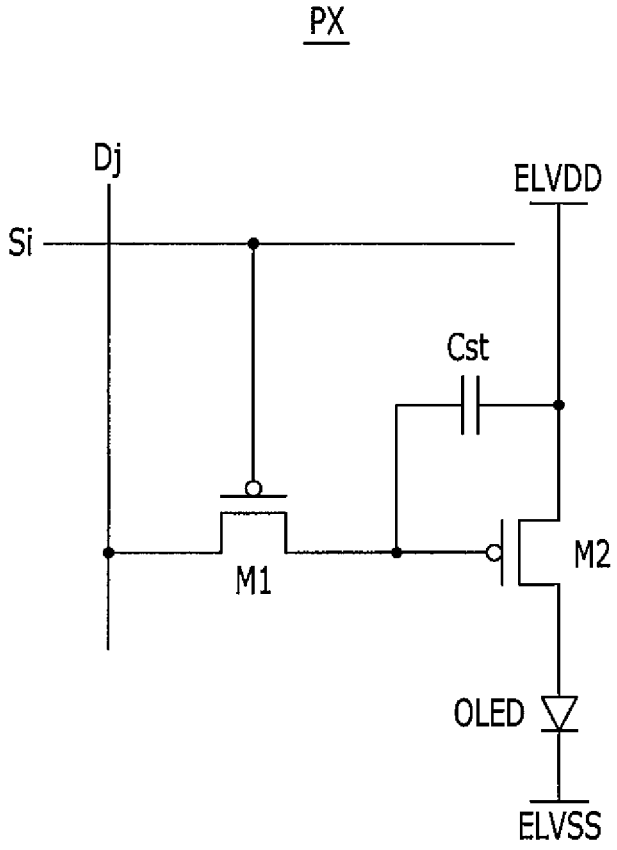
FIG. 2 is a circuit diagram of an example of a pixel of the display device of FIG. 1.

FIG. 2 is a circuit diagram illustrating an example of the pixel PX of the display device 10 of FIG. 1.

Referring to FIG. 2, each pixel PX of the display device 10 includes a switching transistor M1, a driving transistor M2, a sustain capacitor Cst, and an organic light emitting diode (OLED). The switching transistor M1 includes a gate electrode coupled to the i-th scan line Si, a first electrode coupled to j-th data line Dj, and a second electrode coupled to a gate electrode of the driving transistor M2. The driving transistor M2 includes the gate electrode coupled to the second electrode of the switching transistor M1, a first electrode coupled to a first (e.g., ELVDD) power source, and a second electrode coupled to the OLED.

The sustain capacitor Cst includes a first electrode coupled to the second electrode of the switching transistor M1 and a second electrode coupled to the ELVDD power source. The sustain capacitor Cst charges a data voltage applied to the gate electrode of the driving transistor M2 and maintains the charging of the data voltage after the switching transistor M1 is turned off.

The OLED includes an anode coupled to the second electrode of the driving transistor M2 and a cathode coupled to a second (e.g., ELVSS) power source. The OLED may emit light of one of primary colors. An example of primary colors may include red, green, and blue, and a desired color may be displayed by a spatial sum or a temporal sum of the primary colors.

An organic emission layer of the OLED may be formed of a low polymer organic material or a high polymer organic material such as poly 3,4-ethylenedioxythiophene (PEDOT). Further, the organic emission layer may be formed with a multilayer including at least one of an emission layer (EML), a hole injection layer (HIL), a hole transporting layer (HTL), an electron transporting layer (ETL), or an electron injection layer (EIL). When the organic emission layer includes all of the EML, the HIL, the HTL, the ETL, and the EIL, the HIL is disposed on a pixel electrode, which is a positive electrode, and the HTL, the EML, the ETL, and the EIL are sequentially stacked thereon.

For each pixel PX, the organic emission layer may include a red organic emission layer that emits a red color, a green organic emission layer that emits a green color, or a blue organic emission layer that emits a blue color. For example, the red organic emission layer, the green organic emission layer, and the blue organic emission layer may be formed at red pixels, green pixels, and blue pixels, respectively, to display a color image.

In another embodiment, the organic emission layer includes the red organic emission layer, the green organic emission layer, and the blue organic emission layer stacked at each of the red pixels, the green pixels, and the blue pixels, and red color filters, green color filters, and blue color filters, respectively, are formed or provided at the pixels to display a color image. In yet another embodiment, by forming a white organic emission layer that emits white at all of the red pixels, the green pixels, and the blue pixels, and by forming or providing the red color filters, green color filters, and blue color filters at the respective pixels, a color image may be displayed. When a color image is displayed using a white organic emission layer and color filters, a deposition mask or masks for depositing the red organic emission layer, the green organic emission layer, and the blue organic emission layer at respective pixels, i.e., red pixels, green pixels, and blue pixels, may not be used.

For example, the white organic emission layer may be formed as a common organic emission layer that includes a plurality of organic emission layers that combine to emit white. For example, the white organic emission layer may combine at least one yellow organic emission layer and at least one blue organic emission layer, or may combine at least one cyan organic emission layer and at least one red organic emission layer, or may combine at least one magenta organic emission layer and at least one green organic emission layer.

Each of the switching transistor M1 and the driving transistor M2 may be a p-channel field effect transistor (FET). In this case, a gate-on voltage that turns on the switching transistor M1 and the driving transistor M2 is a low-level voltage, and a gate-off voltage that turns off the switching transistor M1 and the driving transistor M2 is a high-level voltage.

In FIG. 2, p-channel FETs are illustrated, but at least one of the switching transistor M1 or the driving transistor M2 may be an n-channel FET. A gate-on voltage that turns on the n-channel FET is a high-level voltage, and a gate-off voltage that turns off the n-channel FET is a low-level voltage. Hereinafter, for ease of description, it will be assumed that the switching transistor M1 included in each of the pixels PX is a p-channel FET and a gate-on voltage that turns on the switching transistor M1 is a low-level voltage.

When the i-th scan signal S[i] of a gate-on voltage is applied to the i-th scan line Si, the switching transistor M1 is turned on, and the j-th data signal D[j] supplied to the j-th data line Dj is applied to a first electrode of a sustain capacitor Cst through the turned-on switching transistor M1 so that the sustain capacitor Cst is charged. The driving transistor M2 controls the amount of current flowing to the OLED from the ELVDD power source corresponding to a voltage charged in the sustain capacitor Cst. The OLED generates light corresponding to the amount of current flowing through the driving transistor M2.

The structure of the pixel shown in FIG. 2 is an example, and the display device 10 is not limited thereto. In other embodiments, the display device 10 may include pixels having other various suitable structures as would be apparent to one of ordinary skill in the art.

Figure 3:
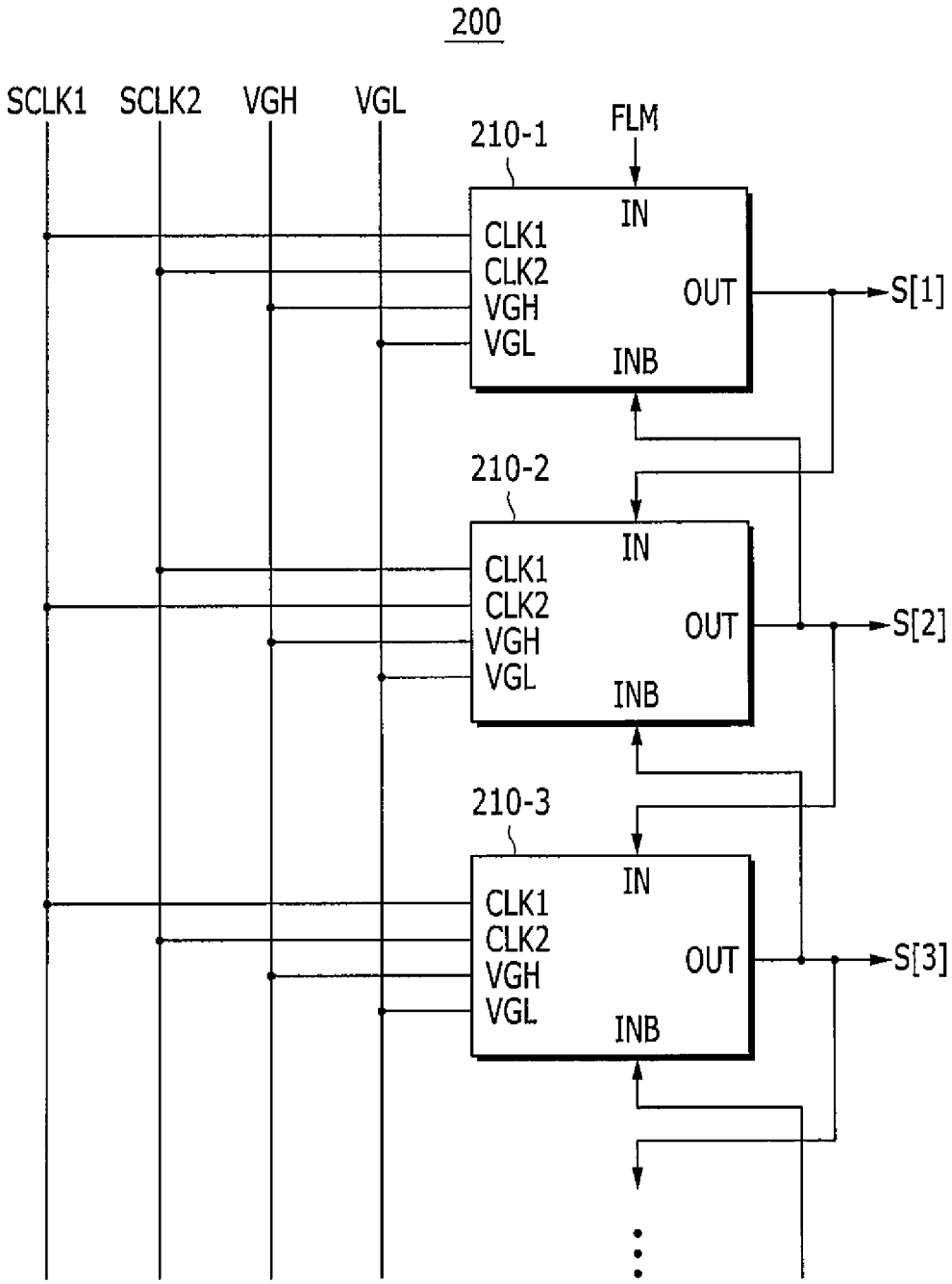
FIG. 3 is a block diagram of an example of a scan driver of the display device of FIG. 1.

FIG. 3 is a block diagram of an example of the scan driver 200 of the display device 10 of FIG. 1.

Referring to FIG. 3, the scan driver 200 includes a plurality of scan-driving blocks 210-1, 210-2, 210-3, . . . , which are sequentially arranged. The scan-driving blocks 210-1, 210-2, 210-3, . . . , generate scan signals S[1], S[2], S[3], . . . , respectively transmitted to the scan lines S1, S2, S3, . . . .

Each of the scan-driving blocks 210-1, 210-2, 210-3, . . . , includes a first clock signal input terminal CLK1, a second clock signal input terminal CLK2, a first signal input terminal IN, a second signal input terminal INB, and an output terminal OUT. The scan-driving blocks 210-1, 210-2, 210-3, . . . , are supplied with a first power source voltage VGH and a second power source voltage VGL. The first power source voltage VGH is a high-level voltage and the second power source voltage VGL is a low-level voltage. The first power source voltage VGH and the second power source voltage VGL supply power for driving the scan-driving blocks 210-1, 210-2, 210-3, . . . .

The first clock signal input terminal CLK1 of each of the odd-numbered scan-driving blocks 210-1, 210-3, 210-5, . . . , is coupled to a wire of the first clock signal SCLK1 and the second clock signal input terminal CLK2 is coupled to a wire of the second clock signal SCLK2. By contrast, the first clock signal input terminal CLK1 of each of the even-numbered scan-driving blocks 210-2, 210-4, 210-6, . . . , is coupled to a wire of the second clock signal SCLK2 and a second clock signal input terminal CLK2 is coupled to a wire of the first clock signal SCLK1.

A frame start signal FLM is applied to the first signal input terminal IN of the first scan-driving block 210-1 while the scan signals S[1], S[2], S[3], . . . , of previous scan-driving blocks 210-1, 210-2, 210-3, . . . , are respectively input to the first signal input terminals IN of the other scan-driving blocks 210-2, 210-3, 210-4, . . . . The second signal input terminal INB of each of the scan-driving blocks 210-1, 210-2, 210-3, . . . , 210-(n−1) is supplied with the respective scan signal S[2], S[3], S[4], . . . , S[n] of the next scan-driving block 210-2, 210-3, 210-4, . . . , 210-*n*.

The scan-driving blocks 210-1, 210-2, 210-3, . . . , respectively output the scan signals S[1], S[2], S[3], . . . , generated according to the signals input to the first signal input terminal IN, the first clock signal input terminal CLK1, the second clock signal input terminal CLK2, and the second signal input terminal INB, to the output terminal OUT. The scan-driving blocks 210-1, 210-2, 210-3, . . . , sequentially output the scan signals S[1], S[2], S[3], . . . , of the gate-on voltage.

Figure 4:
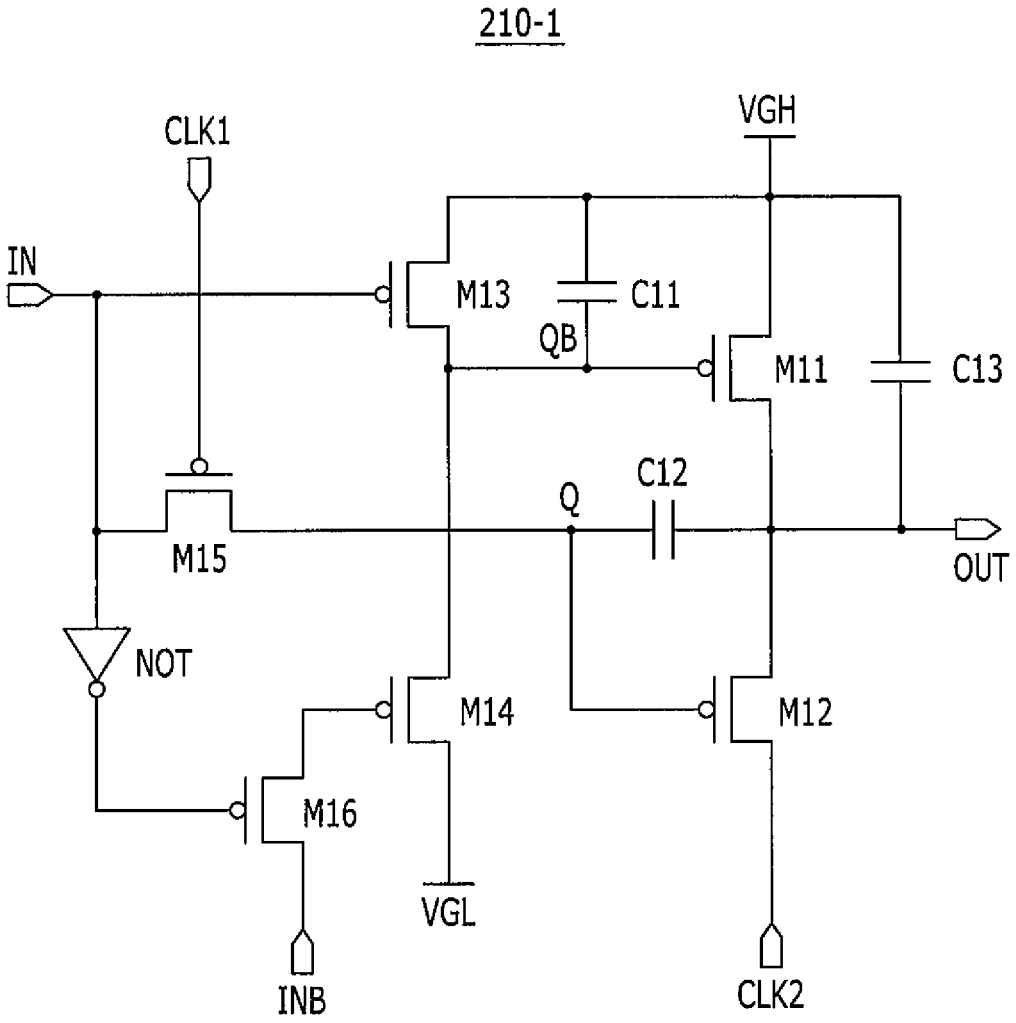
FIG. 4 is a circuit diagram of an example of a first scan-driving block of the scan driver of FIG. 3.

FIG. 4 is a circuit diagram of an example of the first scan-driving block 210-1 of the scan driver 200 of FIG. 3.

Referring to FIG. 4, the first scan-driving block 210-1 includes a first transistor M11, a second transistor M12, a third transistor M13, a fourth transistor M14, a fifth transistor M15, a sixth transistor M16, a NOT gate (identified as NOT), a first capacitor C11, a second capacitor C12, and a third capacitor C13.

The first transistor M11 includes a gate electrode coupled to a first node QB, a first electrode coupled to the first power source voltage VGH, and a second electrode coupled to the output terminal OUT. The first transistor M11 supplies the first power source voltage VGH to the output terminal OUT as the first scan signal S[1] according to a voltage of the first node QB.

The second transistor M12 includes a gate electrode coupled to a second node Q, a first electrode coupled to the second clock signal input terminal CLK2, and a second electrode coupled to the output terminal OUT. The second transistor M12 supplies the second clock signal SCLK2 input through the second clock signal input terminal CLK2 to the output terminal OUT as the first scan signal S[1] according to a voltage of the second node Q.

The third transistor M13 includes a gate electrode coupled to the first signal input terminal IN, a first electrode coupled to the first power source voltage VGH, and a second electrode coupled to the first node QB. The third transistor M13 supplies the first power source voltage VGH to the first node QB according to the frame start signal FLM applied to the first signal input terminal IN.

The fourth transistor M14 includes a gate electrode coupled to a second electrode of the sixth transistor M16, a first electrode coupled to the second power source voltage VGL, and a second electrode coupled to the first node QB. The fourth transistor M14 supplies the second power source voltage VGL to the first node QB according to a voltage supplied by the sixth transistor M16.

The fifth transistor M15 includes a gate electrode coupled to the first clock signal input terminal CLK1, a first electrode coupled to the first signal input terminal IN, and a second electrode coupled to the second node Q. The fifth transistor M15 supplies the frame start signal FLM input through the first signal input terminal IN to the second node Q according to the first clock signal SCLK1 input to the first clock signal input terminal CLK1.

The sixth transistor M16 includes a gate electrode coupled to an output terminal of the NOT gate, a first electrode coupled to the second signal input terminal INB, and the second electrode coupled to the gate electrode of the fourth transistor M14. The sixth transistor M16 supplies the next scan signal S[2] (of the next scan-driving block 210-2) input through the second signal input terminal INB to the gate electrode of the fourth transistor M14 according to a voltage supplied by the NOT gate.

The NOT gate includes an input terminal coupled to the first signal input terminal IN and an output terminal coupled to the gate electrode of the sixth transistor M16. The NOT gate outputs a reverse phase signal of the frame start signal FLM (e.g., inverts the frame start signal FLM) input through the first signal input terminal IN to the gate electrode of the sixth transistor M16. That is, when the frame start signal FLM is input as a high-level voltage to the NOT gate, the NOT gate outputs a low-level voltage to the gate electrode of the sixth transistor M16, and when the frame start signal FLM is input as a low-level voltage, the NOT gate outputs a high-level voltage to the gate electrode of the sixth transistor M16.

The first capacitor C11 includes a first terminal coupled to the first power source voltage VGH and a second terminal coupled to the first node QB. The second capacitor C12 includes a first terminal coupled to the second node Q and a second terminal coupled to the output terminal OUT. The third capacitor C13 includes a first terminal coupled to the first power source voltage VGH and a second terminal coupled to the output terminal OUT.

The first to sixth transistors M11 to M16 may be p-channel FETs. In this case, a gate-on voltage that turns on the first to sixth transistors M11 to M16 is a low-level voltage, and a gate-off voltage that turns off the first to sixth transistors M11 to M16 is a high-level voltage.

Herein, for ease of description, the first to sixth transistors M11 to M16 are described as p-channel FETs, but in other embodiments, at least one of the first to sixth transistors M11 to M16 may be an n-channel FET. In this case, a gate-on voltage that turns on the n-channel FET is a high-level voltage and a gate-off voltage that turns off the n-channel FET is a low-level voltage.

Figure 5:
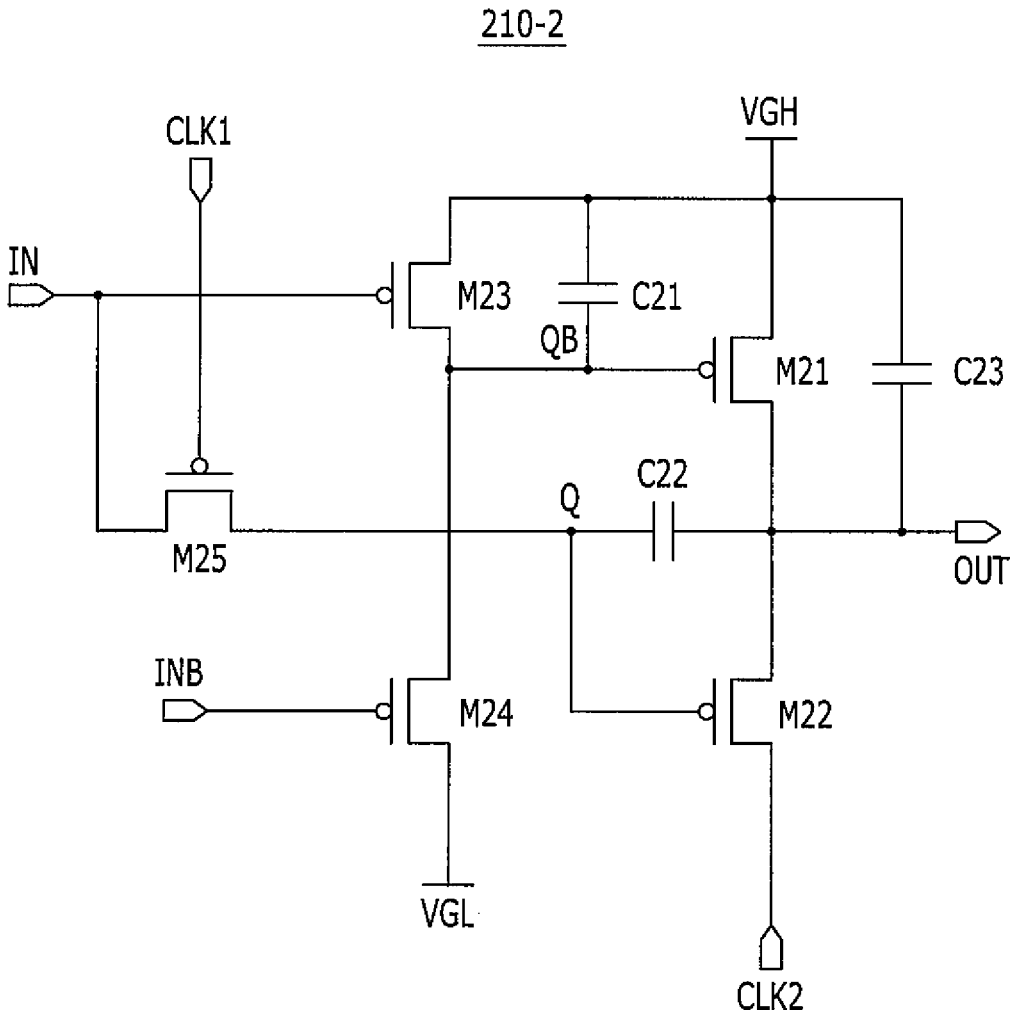
FIG. 5 is a circuit diagram of an example of a second (and each succeeding) scan-driving block of the scan driver of FIG. 3.

FIG. 5 is a circuit diagram of an example of the second (and each succeeding) scan-driving block 210-2 (210-3, 210-4, 210-5, . . . ) of the scan driver 200 of FIG. 3. For ease of description, FIG. 5 is described with respect to the second driving block 210-2, which is similar in operation to the succeeding even scan-driving blocks 210-4, 210-6, 210-8, . . . . The succeeding odd scan-driving blocks 210-3, 210-5, 210-7, . . . , are also similar in operation to the second driving block 210-2, only the assignment of the first clock signal SCLK1 and the second clock signal SCLK2 to the first clock signal input terminal CLK1 and the second clock signal input terminal CLK2 is the same as that of the first scan-driving block 210-1 (and the reverse of that of the second scan-driving block 210-2).

Referring to FIG. 5, the second scan-driving block 210-2 includes a first transistor M21, a second transistor M22, a third transistor M23, a fourth transistor M24, a fifth transistor M25, a first capacitor C21, a second capacitor C22, and a third capacitor C23.

The first transistor M21 includes a gate electrode coupled to the first node QB, a first electrode coupled to the first power source voltage VGH, and a second electrode coupled to the output terminal OUT. The first transistor M21 supplies the first power source voltage VGH to the output terminal OUT as the second scan signal S[2] according to the voltage of the first node QB.

The second transistor M22 includes a gate electrode coupled to the second node Q, a first electrode coupled to the second clock signal input terminal CLK2, and a second electrode coupled to the output terminal OUT. The second transistor M22 supplies the first clock signal SCLK1 input through the second clock signal input terminal CLK2 to the output terminal OUT as the second scan signal S[2] according to the voltage of the second node Q.

The third transistor M23 includes a gate electrode coupled to the first signal input terminal IN, a first electrode coupled to the first power source voltage VGH, and a second electrode coupled to the first node QB. The third transistor M23 supplies the first power source voltage VGH to the first node QB according to the previous scan signal S[1] of the previous scan-driving block (i.e., the first scan-driving block 210-1) applied to the first signal input terminal IN.

The fourth transistor M24 includes a gate electrode coupled to the second signal input terminal INB, a first electrode coupled to the second power source voltage VGL, and a second electrode coupled to the first node QB. The fourth transistor M24 supplies the second power source voltage VGL to the first node QB according to the next scan signal S[3] supplied through the second signal input terminal INB from the next scan-driving block (i.e., the third scan-driving block 210-3).

The fifth transistor M25 includes a gate electrode coupled to the first clock signal input terminal CLK1, a first electrode coupled to the first signal input terminal IN, and a second electrode coupled to the second node Q. The fifth transistor M25 supplies the previous scan signal S[1] input through the first signal input terminal IN to the second node Q according to the second clock signal SCLK2 input to the first clock signal input terminal CLK1.

The first capacitor C21 includes a first terminal coupled to the first power source voltage VGH and a second terminal coupled to the first node QB. The second capacitor C22 includes a first terminal coupled to the second node Q and a second terminal coupled to the output terminal OUT. The third capacitor C23 includes a first terminal coupled to the first power source voltage VGH and a second terminal coupled to the output terminal OUT.

The first to fifth transistors M21 to M25 may be p-channel FETs. In this case, a gate-on voltage that turns on the first to fifth transistors M21 to M25 is a low-level voltage, and a gate-off voltage that turns off the first to fifth transistors M21 to M25 is a high-level voltage.

Herein, for ease of description, the first to fifth transistors M21 to M25 are described as p-channel FETs, but in other embodiments, at least one of the first to fifth transistors M21 to M25 may be an n-channel FET. In this case, a gate-on voltage that turns on the n-channel FET is a high-level voltage and a gate-off voltage than turns off the n-channel FET is a low-level voltage.

In FIG. 4 and FIG. 5, at least one of the transistors M11 to M16 and M21 to M25 may be an oxide thin film transistor having a semiconductor layer made of an oxide semiconductor. The oxide semiconductor may include one of an oxide based on titanium (Ti), hafnium (Hf), zirconium (Zr), aluminum (Al), tantalum (Ta), germanium (Ge), zinc (Zn), gallium (Ga), tin (Sn), or indium (In), such as zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), or hafnium-indium-zinc oxide (Hf—In—Zn—O), which are composite oxides thereof.

The semiconductor layer includes a channel area in which impurities are not doped and source/drain areas in which impurities are doped at both sides of the channel area. Here, such impurities are changed according to a type of thin film transistor being formed and may be an N-type impurity or a P-type impurity.

When a semiconductor layer is formed with an oxide semiconductor, in order to protect an oxide semiconductor that is weak to an outside environment such as exposure to a high temperature, a separate protection layer may be added.

The scan-driving blocks 210-2, 210-3, 210-4, . . . , other than the first scan-driving block 210-1 in the scan-driving blocks 210-1, 210-2, 210-3, . . . , included in the scan driver 200 of FIG. 3 may have the same structure as the second scan-driving block 210-2 described in FIG. 5. Hereinafter, the scan-driving blocks 210-2, 210-3, 210-4, . . . , other than the first scan-driving block 210-1 will be described with reference to the second scan-driving block 210-2 shown in FIG. 5.

In the first scan-driving block 210-1 of FIG. 4, the NOT gate outputs a gate-on voltage (i.e., low-level voltage) when the frame start signal FLM is not being supplied as a gate on voltage (i.e., when the frame start signal FLM is a high-level voltage) to keep the sixth transistor M16 turned on, and the next scan signal S[2] input to the second signal input terminal INB may be applied to the gate electrode of the fourth transistor M14. That is, the first scan-driving block 210-1 may be operated similarly to the second scan-driving block 210-2 of FIG. 5 for all but the time when the frame start signal FLM is applied as a gate-on voltage (i.e., low-level voltage).

Figure 6:
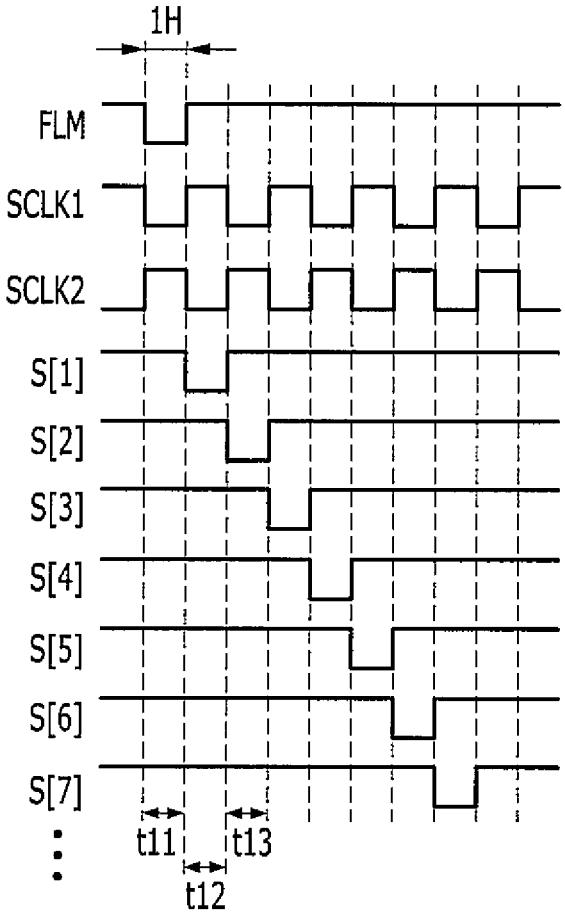
FIG. 6 is a timing diagram of an example of a driving method of the scan driver of FIG. 3.

FIG. 6 is a timing diagram of an example of a driving method of the scan driver 200 of FIG. 3.

Referring to FIG. 3 to FIG. 6, the first clock signal SCLK1 and the second clock signal SCLK2 alternate between a high-level voltage and a low-level voltage with a unit of one horizontal period 1H. In this case, the second clock signal SCLK2 is a reverse phase signal of the first clock signal SCLK1. The one horizontal period 1H may be the same as one period of the horizontal synchronization signal Hsync and the data enable signal DE.

During a first period t11, the frame start signal FLM is supplied as a low-level voltage to the first signal input terminal IN of the first scan-driving block 210-1, while the first clock signal SCLK1 is supplied as a low-level voltage and the second clock signal SCLK2 is supplied as a high-level voltage. In the first scan-driving block 210-1, the first clock signal SCLK1 is input to the first clock signal input terminal CLK1 and the second clock signal SCLK2 is input to the second clock signal input terminal CLK2. Accordingly, the third transistor M13 is turned on by the frame start signal FLM and the fifth transistor M15 is turned on by the first clock signal SCLK1. The first power source voltage VGH is applied to the first node QB through the turned-on third transistor M13.

As a result, a voltage of the first node QB becomes a high-level voltage, and the first transistor M11 is turned off by the high-level voltage of the first node QB. A low-level frame start signal FLM is applied to the second node Q through the turned-on fifth transistor M15. The voltage of the second node Q becomes a low-level voltage, and the second transistor M12 is turned on by the low-level voltage of the second node Q. A high-level second clock signal SCLK2 is output to the output terminal OUT as the first scan signal S[1] through the turned-on second transistor M12. That is, the first scan signal S[1] of a high-level voltage is output. In this case, the second capacitor C12 is charged with a low-level voltage of the second node Q and a high-level voltage of the output terminal OUT.

During a second period t12, the frame start signal FLM and the first clock signal SCLK1 are each supplied as a high-level voltage, and the second clock signal SCLK2 is supplied as a low-level voltage. In the first scan-driving block 210-1, the third transistor M13 is turned off by the frame start signal FLM and the fifth transistor M15 is turned off by the first clock signal SCLK1. In this case, the frame start signal FLM of the high-level voltage is applied to the NOT gate and a low-level voltage is output through the NOT gate such that the sixth transistor M16 is turned on.

Since the second scan signal S[2] of the high-level voltage is input to the second signal input terminal INB, a high-level voltage is applied to the gate electrode of the fourth transistor M14 through the turned-on sixth transistor M16, and the fourth transistor M14 is turned off. Then, the first node QB floats, so the voltage of the first node QB maintains a high-level voltage. As the fifth transistor M15 is turned off, the second node Q also floats. The voltage of the second node Q becomes a lower level voltage due to a bootstrap by the second capacitor C12. The second transistor M12 maintains the turned-on state by this lower-level voltage of the second node Q, and the second clock signal SCLK2 of the low-level voltage is output to the output terminal OUT as the first scan signal S[1]. That is, the first scan signal S[1] of the gate-on voltage is output.

Meanwhile, in the second scan-driving block 210-2, the second clock signal SCLK2 is input to the first clock signal input terminal CLK1, the first clock signal SCLK1 is supplied to the second clock signal input terminal CLK2, and the first scan signal S[1] of the low-level voltage is supplied to the first signal input terminal IN during the second period t12. Thus, the second scan-driving block 210-2 outputs a second scan signal S[2] of a low-level voltage during a third period t13 that is delayed by one horizontal period 1H from the first scan signal S[1].

During the third period t13, the second scan signal S[2] of the low-level voltage is input to the second signal input terminal INB of the first scan-driving block 210-1. In this case, the frame start signal FLM is a high-level voltage, so a low-level voltage is applied to the gate electrode of the sixth transistor M16 through the NOT gate. The sixth transistor M16 is turned on, and the second scan signal S[2] of the low-level voltage input to the second signal input terminal INB is applied to the gate electrode of the fourth transistor M14.

Then, the fourth transistor M14 is turned on and the second power source voltage VGL is applied to the first node QB. The voltage of the first node QB becomes a low-level voltage, and the first transistor M11 is turned on by the voltage of the first node QB. The first power source voltage VGH is output to the output terminal OUT as the first scan signal S[1] through the turned-on first transistor M11. That is, the first scan signal S[1] of the gate-off voltage is output. In this case, the first clock signal SCLK1 is applied as a low-level voltage, and therefore the fifth transistor M15 is turned on and a frame start signal FLM of the high-level voltage is applied to the second node Q through the turned-on fifth transistor M15. The second transistor M12 is turned off by the high-level voltage of the second node Q.

With the above-stated method, the scan-driving blocks 210-1, 210-2, 210-3, . . . , sequentially output the scan signals S[1], S[2], S[3], . . . , respectively, of the gate-on voltage. The operation of the scan-driving blocks 210-1, 210-2, 210-3, . . . , sequentially outputting the scan signals S[1], S[2], S[3], . . . , of the gate-on voltage is repeated for each frame. Power may be abnormally turned off while the scan-driving blocks 210-1, 210-2, 210-3, . . . , sequentially output the scan signals S[1], S[2], S[3], . . . , of the gate-on voltage. Hereinafter, an operation of the scan driver 200 during the abnormal power-off will be described.

Figure 7:
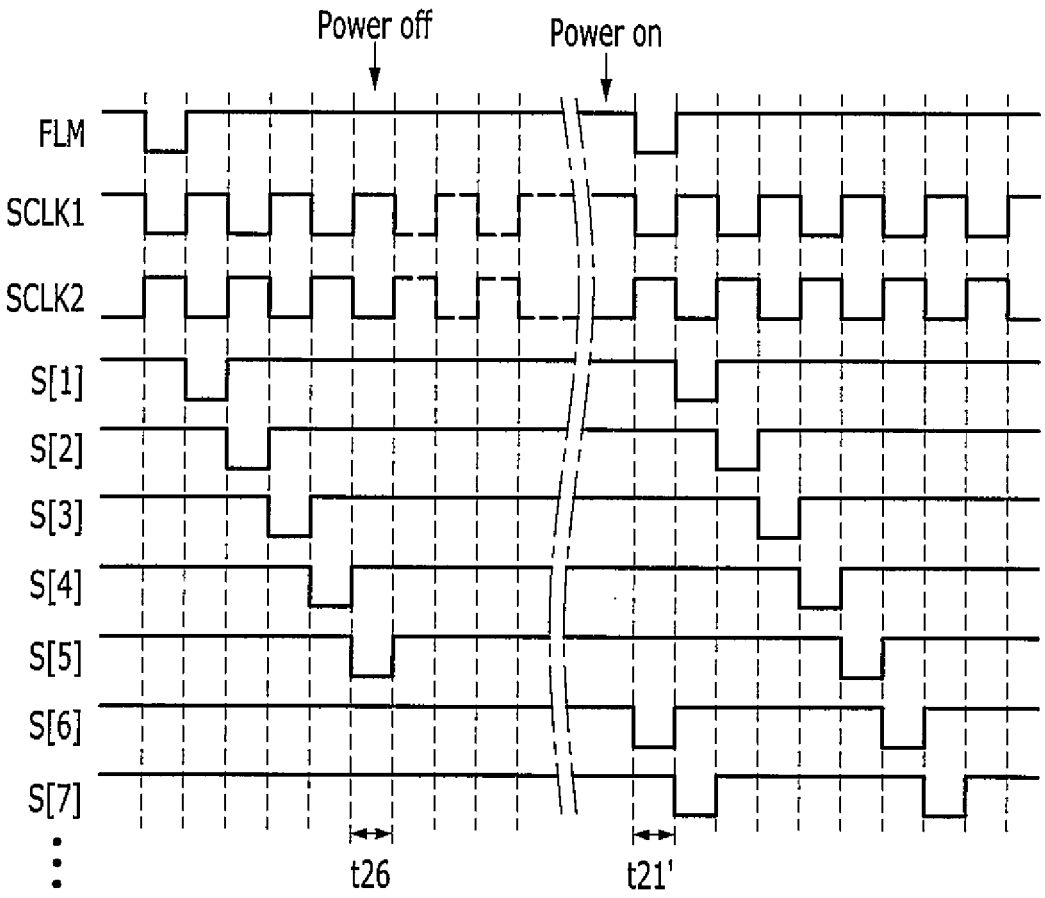
FIG. 7 is a timing diagram illustrating an example of an operation of the driving method of FIG. 6 during an abnormal power-off.

FIG. 7 is a timing diagram of an example of the operation of the driving method of FIG. 6 during the abnormal power-off.

Referring to FIG. 7, it is assumed that power is abnormally turned off in a sixth period t26 during which the fifth scan signal S[5] of a gate-on voltage is output while the scan signals S[1], S[2], S[3], . . . , of the gate-on voltage are being sequentially output from the scan driver 200.

In the sixth period t26, a fifth scan signal S[5] of a low-level voltage is input to the first signal input terminal IN of the sixth scan-driving block 210-6, a second clock signal SCLK2 of a low-level voltage is input to the first clock signal input terminal CLK1, and a first clock signal SCLK1 of a high-level voltage is input to the second clock signal input terminal CLK2. Thus, a low-level voltage is applied to the second node Q of the sixth scan-driving block 210-6 and a high-level voltage is applied to the first node QB. The second capacitor C22 of the sixth scan-driving block 210-6 is charged with the low-level voltage of the second node Q and the high-level voltage of the output terminal OUT. As power is turned off, the first clock signal SCLK1 and the second clock signal SCLK2 are not output, and therefore, the operation of the scan driver 200 is stopped while the second node Q of the sixth scan-driving block is charged with the low-level voltage.

After that, when the power is turned on during a new first period t21', the sequential output of the scan signals S[1], S[2], S[3], . . . , of the gate-on voltage is started from the first scan-driving block 210-1. In this case, the second node Q2 of the sixth scan-driving block 210-6 is charged with the low-level voltage, and a first clock signal SCLK1 of a low-level voltage is input to the second clock signal input terminal CLK2 of the sixth scan-driving block 210-6. The second transistor M22 is turned on by the low-level voltage of the second node Q, and the first clock signal SCLK1 of the low-level voltage is output to the output terminal OUT as the sixth scan signal S[6] through the turned-on second transistor M22. That is, a sixth scan signal S[6] of a gate-on voltage is output from the sixth scan-driving block 210-6 during the new first period t21'. Since the sixth scan signal S[6] of the gate-on voltage is output from the sixth scan-driving block 210-6, the next scan-driving blocks 210-7, 210-8, 210-9, . . . , sequentially output scan signals S[7], S[8], S[9], . . . , respectively, of the gate-on voltage.

As described, when the power is turned on again after the abnormal power-off, normal scan signals S[1], S[2], S[3], . . . , sequentially output starting from the first scan-driving block 210-1 while abnormal scan signals (in this case, scan signals S[6], S[7], S[8], . . . ) sequentially output starting from the scan-driving block (in this case, scan-driving block 210-6) having the second node Q charged with the low-level voltage are simultaneously output. That is, a dual scan occurs.

Due to such a dual scan, data signals are dually applied to a plurality of pixels such that an image may not be normally displayed. The dual scan disappears after the first frame and an image may be normally displayed from the second frame.

In a comparable scan driver, the scan-driving blocks included in the scan driver may all have a structure shown in FIG. 5. In this case, the dual scan that occurs due to abnormal power-off disappears after the first frame, and a normal image may be displayed from the second frame.

However, when the scan-driving blocks included in the scan driver all have the structure illustrated in FIG. 5 and the abnormal power-off occurs at a time that the first scan signal S[1] of the first scan-driving block is output, the first power source voltage VGH and the second power source voltage VGL may be short-circuited and thus, the scan driver may be damaged. Hereinafter, referring to FIG. 8, occurrence of a short-circuit due to an abnormal power-off when the scan-driving blocks included in a scan driver are all formed with the structure of FIG. 5 will be described.

Figure 8:
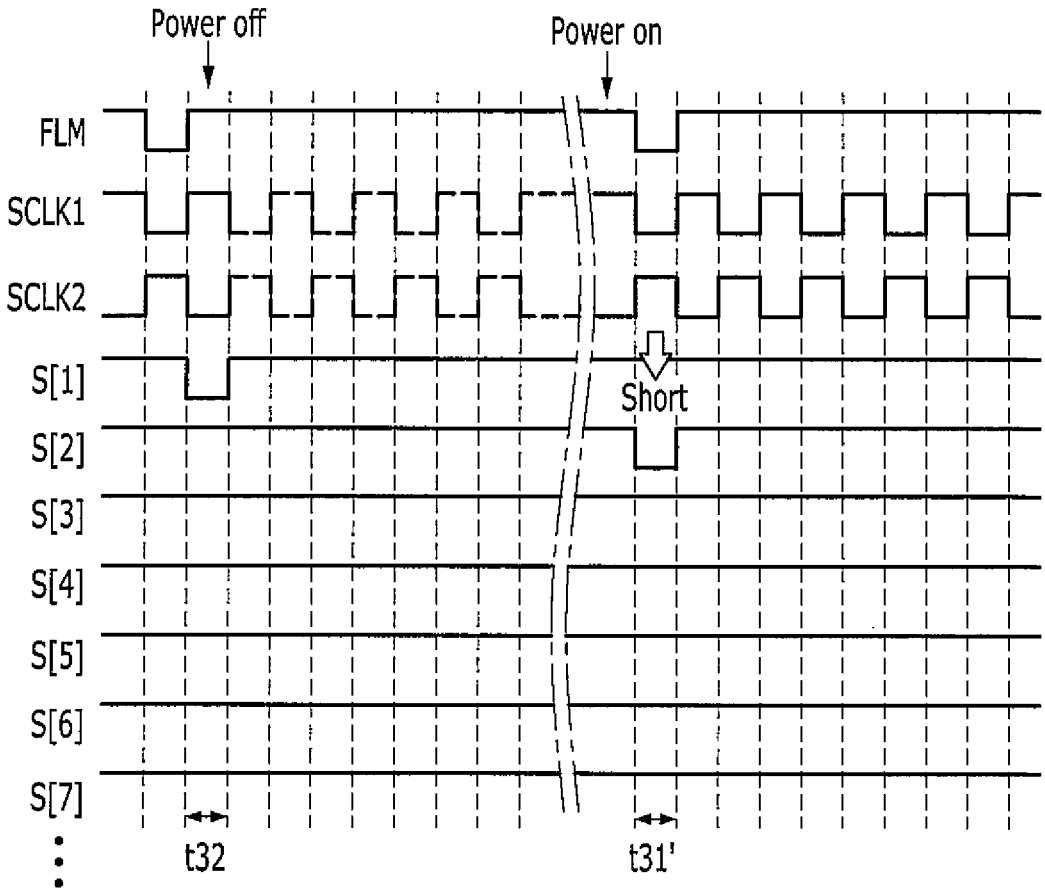
FIG. 8 is a timing diagram of a short-circuit that may occur due to an abnormal power-off in a scan driver without the first scan-driving block of FIG. 4.

FIG. 8 is a timing diagram of a short-circuit that may occur due to an abnormal power-off in a scan driver without the first scan-driving block 210-1 of FIG. 4.

Referring to FIG. 8, the scan-driving blocks included in the scan driver are assumed to be formed with the structure of FIG. 5. It is further assumed that the abnormal power-off occurs in a second period t32 during which the first scan signal S[1] of the gate-on voltage is output while the scan signals S[1], S[2], S[3], . . . , of the gate-on voltage are supposed to be sequentially output.

During the second period t32, a first scan signal S[1] of a low-level voltage is input to the first signal input terminal IN of the second scan-driving block, a second clock signal SCLK2 of a low-level voltage is input to the first clock signal input terminal CLK1, and a first clock signal SCLK1 of a high-level voltage is input to the second clock signal input terminal CLK2. A low-level voltage is applied to the second node Q of the second scan-driving block and a high-level voltage is applied to the first node QB. The second capacitor C22 of the second scan-driving block is charged with the low-level voltage of the second node Q and the high-level voltage of the output terminal OUT. Since the first clock signal SCLK1 and the second clock signal SCLK2 are not output due to the power-off, operation of the scan driver is stopped while the second node Q of the second scan-driving block is being charged with the low-level voltage.

After that, when the power is turned on during a new first period t31', the second transistor M22 of the second scan-driving block is turned on by the low-level voltage charged in the second node Q, and the first clock signal SLCK1 of the low-level voltage, input through the second clock signal input terminal CLK2, is output to the output terminal OUT as the second scan signal S[2]. That is, the second scan signal S[2] of the low-level voltage is output during the new first period t31'.

During the new first period t31', the second scan signal S[2] of a gate-on voltage is input to the second signal input terminal INB of the first scan-driving block. In this case, a frame start signal FLM of a low-level voltage is applied to the first signal input terminal IN of the first scan-driving block, a first clock signal SCLK1 of a low-level voltage is applied to the first clock signal input terminal CLK1, and a second clock signal SCLK2 of a high-level voltage is input to the second clock signal input terminal CLK2. The third transistor M23 is turned on by the frame start signal FLM of the low-level voltage input through the first signal input terminal IN, and the fourth transistor M24 is turned on by the second scan signal S[2] of the low-level voltage input to the second signal input terminal INB.

However, since both the third transistor M23 and the fourth transistor M24 are turned on, the first power source voltage VGH and the second power source voltage VGL are short-circuited. The first power source voltage VGH and the second power source voltage VGL are power for driving the scan driver, and have a large voltage difference. Accordingly, when the first power source voltage VGH and the second power source voltage VGL having a large voltage difference are short-circuited, the scan driver may be damaged in a hardware manner.

As described, when the scan-driving blocks included in the scan driver are all formed with the structure of FIG. 5, the first power source voltage VGH and the second power source voltage VGL may be short-circuited due to occurrence of an abnormal power-off. However, the first scan-driving block 210-1 of the proposed scan driver 200 is formed with the structure of FIG. 4, and therefore the above-stated problem may be prevented. Hereinafter, a method for preventing a short-circuit between the first power source voltage VGH and the second power source voltage VGL that may occur due to an abnormal power-off in the scan driver 200 will be described with reference to FIG. 9.

Figure 9:
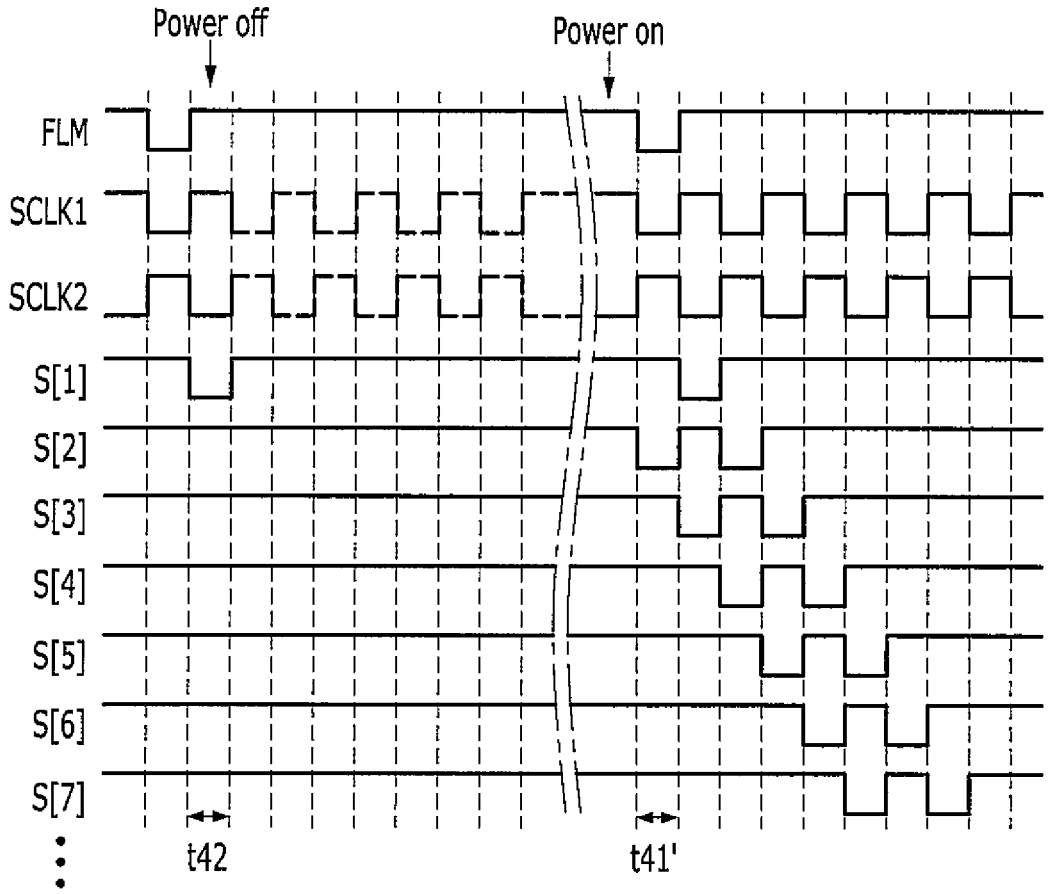
FIG. 9 is a timing diagram illustrating another example of the operation of the driving method of FIG. 6 during an abnormal power-off.

FIG. 9 is a timing diagram of another example of the operation of the driving method of FIG. 6 during an abnormal power-off.

Referring to FIG. 9, the first scan-driving block 210-1 of the scan driver 200 is formed with the structure of FIG. 4, and other scan-driving blocks 210-2, 210-3, 210-4, . . . , are formed with the structure of FIG. 5. It is assumed that the abnormal power-off occurs in a second period t42 during which the first scan signal S[1] of the gate-on voltage is output while the scan signals S[1], S[2], S[3], . . . , of the gate-on voltage are intended to be sequentially output.

During the second period t42, the first scan signal S[1] of a low-level voltage is input to the first signal input terminal IN of the second scan-driving block 210-2, the second clock signal SCLK2 of a low-level voltage is input to the first clock signal input terminal CLK1, and the first clock signal SCLK1 of a high-level voltage is input to the second clock signal input terminal CLK2. A low-level voltage is applied to the second node Q of the second scan-driving block 210-2 and a high-level voltage is applied to the first node QB. The second capacitor C22 of the second scan-driving block 210-2 is charged with the low-level voltage of the second node Q and the high-level voltage of the output terminal OUT. Since the first clock signal SCLK1 and the second clock signal SCLK2 are not output due to the abnormal power-off, operation of the scan driver is stopped while the second node Q of the second scan-driving block 210-2 is being charged with the low-level voltage.

After that, when the power is turned on during a new first period t41', the second transistor M22 of the second scan-driving block is turned on by the low-level voltage charged in the second node Q, and the first clock signal SLCK1 of the low-level voltage, input through the second clock signal input terminal CLK2, is output to the output terminal OUT as the second scan signal S[2]. That is, the second scan signal S[2] of the low-level voltage is output during the new first period t41'.

During the new first period t41', the second scan signal S[2] of a gate-on voltage is input to the second signal input terminal INB of the first scan-driving block 210-1. In this case, the frame start signal FLM of a low-level voltage is applied to the first signal input terminal IN of the first scan-driving block 210-1, the first clock signal SCLK1 of a low-level voltage is applied to the first clock signal input terminal CLK1, and the second clock signal SCLK2 of a high-level voltage is input to the second clock signal input terminal CLK2.

In the first scan-driving block 210-1, the frame start signal FLM of the low-level voltage, applied to the first signal input terminal IN, is inverted to a high-level voltage through the NOT gate and then applied to the gate electrode of the sixth transistor M16. The sixth transistor M16 is turned off, and the second scan signal S[2] of the gate-on voltage, applied to the second signal input terminal INB, is blocked. That is, the fourth transistor M14 maintains the turned-off state. Thus, as the third transistor M13 is turned on by the frame start signal FLM of the low-level voltage and thus, the first power source voltage VGH is applied to the first node QB, application of the second power source voltage VGL to the first node QB is blocked so that the occurrence of a short-circuit between the first power source voltage VGH and the second power source voltage VGL can be prevented.

Figure 10:
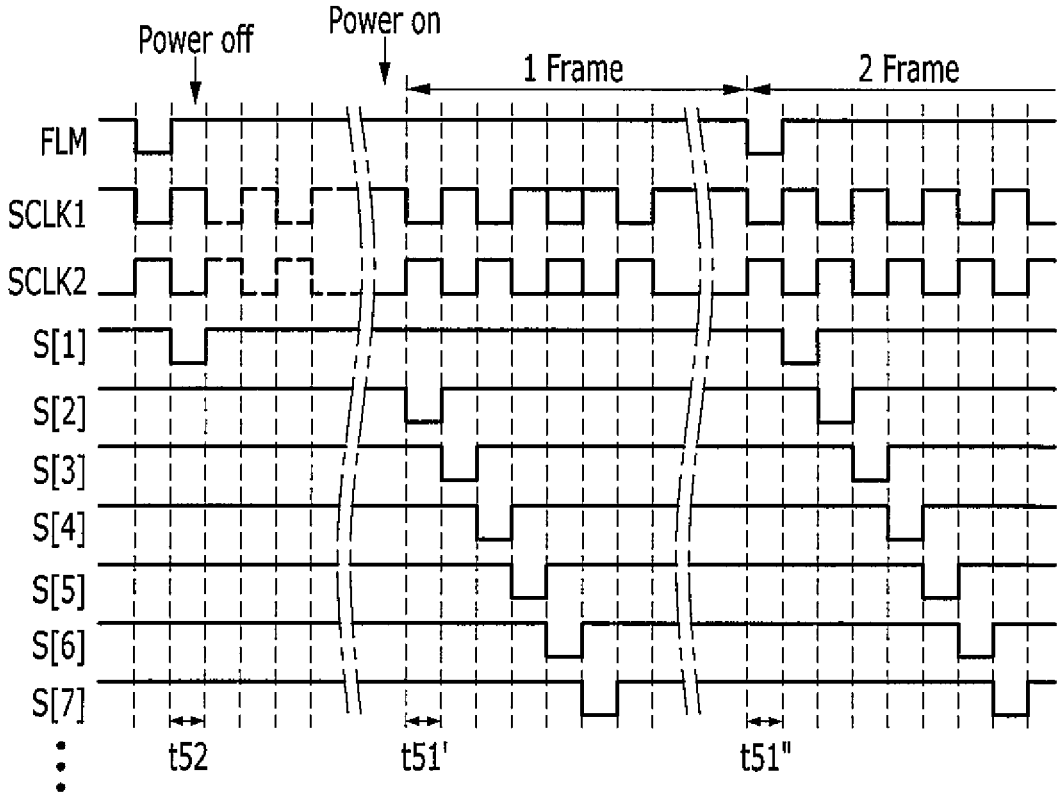
FIG. 10 is a timing diagram illustrating yet another example of the operation of the driving method of FIG. 6 during an abnormal power-off.

FIG. 10 is a timing diagram of yet another example of the operation of the driving method of FIG. 6 during an abnormal power-off.

Referring back to FIG. 9, when the power is turned on again in a new first period t41' after the abnormal power-off during a second period t42, normal scan signals (sequentially output starting from the first scan-driving block 210-1) and abnormal scan signals (sequentially output starting from the second scan-driving block 210-2 having the second node Q charged with the low-level voltage) are simultaneously output. That is, a dual scan occurs.

In order to prevent such a dual scan, in FIG. 10, the frame start signal FLM is not applied as a gate-on voltage, that is, a low-level voltage, in the first frame after power is turned on. Rather, the frame start signal FLM is applied as a gate-on voltage starting with the second frame after the power on.

It is assumed in FIG. 10 that while the scan signals S[1], S[2], S[3], . . . , of the gate-on voltage are intended to be sequentially output from the scan driver 200, power is abnormally turned off in a second period t52 during which the first scan signal S[1] of the gate-on voltage is output.

As described above with reference to FIG. 9, the second capacitor C22 of the second scan-driving block 210-2 is charged with the low-level voltage of the second node Q and the high-level voltage of the output terminal OUT. The operation of the scan driver 200 is stopped while the second node Q of the second scan-driving block 210-2 is charged with the low-level voltage.

After that, when the power is turned on, this time in a new first period t51', the second transistor M22 of the second scan-driving block 210-2 is turned on by the low-level voltage charged in the second node Q, and the first clock signal SCLK1 of the low-level voltage input through the second clock signal input terminal CLK2 is output to the output terminal OUT as the second scan signal S[2]. That is, the second scan signal S[2] of the low-level voltage is output during the new first period t51'. As the second scan signal S[2] of the gate-on voltage is output from the second scan-driving block 210-2, the next scan-driving blocks 210-3, 210-4, 210-5, . . . , sequentially output scan signals S[3], S[4], S[5], . . . , of the gate-on voltage.

However, in this case, since the frame start signal FLM of the gate-on voltage is not applied in the first frame after the power on, normal scan signals S[1], S[2], S[3], . . . , sequentially output starting from the first scan-driving block 210-1 are not output. Therefore, simultaneous output of normal scan signals and abnormal scan signals, that is, a dual scan, can be prevented in the first frame after the power is turned on from the abnormal power-off. That is, dual application of data signals to the pixels due to the dual scan can be prevented so that an image may be normally displayed.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims, and their equivalents. Therefore, those skilled in the art will understand that various suitable modifications and equivalent other embodiments of the present invention are possible. Consequently, the true technical protective scope of the present invention must be determined based on the technical spirit of the appended claims, and their equivalents.

DESCRIPTION OF SOME SYMBOLS

100: signal controller
200: scan driver
210: scan-driving block
300: data driver
500: display unit
PX: pixel

What is claimed is:

1. A scan driver comprising:
a plurality of scan-driving blocks, each of the scan-driving blocks comprising:
a first transistor having a gate electrode coupled to a first node and configured to supply a first power source voltage to an output terminal in response to a voltage of the first node;
a second transistor having a gate electrode coupled to a second node and configured to couple a second clock signal input terminal to the output terminal;
a third transistor having a gate electrode coupled to a first signal input terminal and configured to supply the first power source voltage to the first node in response to a first signal being applied to the first signal input terminal;
a fourth transistor having a gate electrode coupled to a second signal input terminal and configured to supply a second power source voltage directly to the first node; and
a fifth transistor having a gate electrode coupled to a first clock signal input terminal and configured to transmit the first signal from the first signal input terminal to the second node,
wherein a first scan-driving block of the scan-driving blocks further comprises:
a sixth transistor directly coupled between the second signal input terminal and the gate electrode of the fourth transistor and configured to transmit a second signal from the second signal input terminal directly to the gate electrode of the fourth transistor; and
a NOT gate separate from the first through sixth transistors, directly coupled to the first signal input terminal, and configured to invert the first signal input through the first signal input terminal and to supply the inverted first signal directly to the gate electrode of the sixth transistor.

2. The scan driver of claim 1, wherein each of the scan-driving blocks further comprises a first capacitor including a first terminal coupled to the first power source voltage and a second terminal coupled to the first node.

3. The scan driver of claim 1, wherein each of the scan-driving blocks further comprises a second capacitor including a first terminal coupled to the second node and a second terminal coupled to the output terminal.

4. The scan driver of claim 1, wherein each of the scan-driving blocks further comprises a third capacitor including a first terminal coupled to the first power source voltage and a second terminal coupled to the output terminal.

5. The scan driver of claim 1, wherein the first signal input terminal of the first scan-driving block is configured to receive a frame start signal as the first signal, and the first signal input terminal of each of the scan-driving blocks after the first scan-driving block is configured to receive a scan signal from a corresponding previous one of the scan-driving blocks as the first signal.

6. The scan driver of claim 1, wherein the second signal input terminal of each of the scan-driving blocks before a final one of the scan-driving blocks is configured to receive a scan signal of a corresponding next one of the scan-driving blocks as the second signal.

7. A display device comprising:
a plurality of pixels;
a scan driver configured to sequentially apply scan signals of a gate-on voltage to a plurality of scan lines coupled to the pixels; and
a data driver configured to apply data signals to a plurality of data lines coupled to the pixels,
wherein the scan driver comprises a plurality of scan-driving blocks, and
wherein a first scan-driving block of the scan-driving blocks comprises:
a first transistor having a gate electrode coupled to a first node and configured to supply a first power source voltage to an output terminal in response to a voltage of the first node;
a second transistor having a gate electrode coupled to a second node and configured to couple a second clock signal input terminal to the output terminal;
a third transistor having a gate electrode coupled to a first signal input terminal and configured to supply the first power source voltage to the first node in response to a first signal being applied to the first signal input terminal;
a fourth transistor having a gate electrode coupled to a second signal input terminal and configured to supply a second power source voltage directly to the first node;
a fifth transistor having a gate electrode coupled to a first clock signal input terminal and configured to transmit the first signal from the first signal input terminal to the second node;
a sixth transistor directly coupled between the second signal input terminal and the gate electrode of the fourth transistor and configured to transmit a second signal from the second signal input terminal directly to the gate electrode of the fourth transistor; and
a NOT gate separate from the first through sixth transistors, directly coupled to the first signal input terminal, and configured to invert the first signal input through the first signal input terminal and to supply the inverted first signal directly to the gate electrode of the sixth transistor.

8. The display device of claim 7, wherein the first scan-driving block further comprises a first capacitor including a first terminal coupled to the first power source voltage and a second terminal coupled to the first node.

9. The display device of claim 7, wherein the first scan-driving block further comprises a second capacitor including a first terminal coupled to the second node and a second terminal coupled to the output terminal.

10. The display device of claim 7, wherein the first scan-driving block further comprises a third capacitor including a first terminal coupled to the first power source voltage and a second terminal coupled to the output terminal.

11. The display device of claim 7, wherein the first signal input terminal of the first scan-driving block is configured to receive a frame start signal as the first signal, and the second signal input terminal of the first scan-driving block is configured to receive a scan signal from a second one of the scan-driving blocks as the second signal.

* * * * *